US005387759A

United States Patent [19]

Usa

[11] Patent Number: 5,387,759

[45] Date of Patent: Feb. 7, 1995

[54] AUTOMATIC PERFORMANCE APPARATUS USING SEPARATELY STORED NOTE AND TECHNIQUE DATA FOR REDUCING PERFORMANCE DATA STORAGE REQUIREMENTS

[75] Inventor: Satoshi Usa, Hamamatsu, Japan

[73] Assignee: Yamaha Corporation, Japan

[21] Appl. No.: 856,474

[22] Filed: Mar. 24, 1992

[30] Foreign Application Priority Data

Mar. 29, 1991 [JP] Japan ..... 3-067252

[51] Int. Cl.[6] ..... G10H 7/00; G04B 13/00; A63H 5/00

[52] U.S. Cl. ..... 84/609; 84/626; 84/627; 84/629

[58] Field of Search ..... 84/609, 626, 627, 629

[56] References Cited

U.S. PATENT DOCUMENTS 4,602,546 7/1986 Shinohara .
4,920,851 5/1990 Abe ..... 84/626
4,930,390 6/1990 Kellogg et al. ..... 84/611
4,972,753 11/1990 Adachi et al. ..... 84/626
5,085,118 2/1992 Sekizuka ..... 84/635
5,142,960 9/1992 Iwase et al. ..... 84/662
5,170,003 12/1992 Kawashima ..... 84/619

*Primary Examiner*—Jonathan Wysocki
*Assistant Examiner*—Jeffrey W. Donels
*Attorney, Agent, or Firm*—Graham & James

[57] ABSTRACT

An automatic performance apparatus stores performance technique designating data and an automatic performance data in a sequence memory, and performance technique data which varies in a lapse of time in a performance data memory to reduce the amount of sequence memory. When the performance technique designating data is detected during the performance, the performance technique data corresponding to the detected performance technique designating data is read out. The performance technique data controls musical tones specified by the automatic performance data. Thus, various performance technique can be realized with a small amount of sequence data.

7 Claims, 10 Drawing Sheets

FIG. 2

| STRING INSTRUMENTS ( BOW VELOCITY, BOW PRESSURE ENVELOPE ) | SAXOPHONE ( BREATH PRESSURE, EMBOUCHURE, ENVELOPE ) |
|---|---|
| ATTACK ( FAST, SLOW, DETACHE ) | ATTACK ( FAST, SLOW, TONGUING REPRESENTATION ) |
| RELEASE ( FAST, SLOW, ETC. ) | RELEASE ( FAST, SLOW, TONGUING REPRESENTATION ) |
| SUSTAIN ( pp, p, ---, ff, ) | SUSTAIN ( pp, p, ---, ff ) |
| CRESCENDO, DIMINUENDO | CRESCENDO ( FAST, SLOW ) DIMINUENDO |
| SPICCATO | SOBBING TONE TECHNIQUE |
| TREMOLO | DIRTY TONE TECHNIQUE |
| ⋮ | SUBTONE TECHNIQUE |
| | ⋮ |

FIG. 7(A)

TIMING
PITCH AND NOTE LENGTH
FAST ATTACK
FAST CRESCENDO
mf IN SUSTAIN
FAST RELEASE

TIMING
PITCH AND NOTE LENGTH
SHARP DETACHED ATTACK
FAST TREMOLO
FAST RELEASE

TIMING
PITCH AND NOTE LENGTH
FAST ATTACK
SLOW CRESCENDO
•
•

•
•
•

TIMING
PITCH AND NOTE LENGTH
FAST RELEASE
SLOW DIMINUENDO
pp IN SUSTAIN
SLOW RELEASE

ENDING

FIG. 7(B)

TIMING
PITCH AND NOTE LENGTH
TONGUED ATTACK
FAST DIMINUENDO
mf IN SUSTAIN
SLOW CRESCENDO
f IN SUSTAIN
TONGUED RELEASE

TIMING
PITCH AND NOTE LENGTH
SUBTONE ATTACK
FAST DIMINUENDO

TIMING
PITCH AND NOTE LENGTH
SLOW ATTACK
DIRTY TONE
•
•

•
•

•
•
FAST DIMINUENDO
FAST CRESCENDO
TONGUED RELEASE

ENDING

AUTOMATIC PERFORMANCE APPARATUS USING SEPARATELY STORED NOTE AND TECHNIQUE DATA FOR REDUCING PERFORMANCE DATA STORAGE REQUIREMENTS

BACKGROUND OF THE INVENTION

1. Field of the Invention

The present invention relates to an electronic musical instruments having high representation automatic performance function with a small amount of performance data.

2. Related Art

A conventional automatic performance apparatus stores tone pitch data and tone generation level data with tone generation timing data of musical tones to be generated.

To improve performance representation, the conventional automatic performance apparatus, particularly in an event style automatic performance apparatus which stores performance data at its respective alteration, stores various performance data such as after-touch event data with the timing data during its performance.

However, some kind of performance technique can not be expressed in the event style.

In addition, an amount of the performance data enormously increases when the performance data for an delicate performance technique is expressed in the event style. Particularly, in an physical model tone generator disclosed in, for example, U.S. patent application Ser. No. 07/520,231 filed on May 8th, 1990 assigned to the same assignee of the present application, which models plural kinds of parameters which are used in musical performance by an actual natural instrument, the values of parameters change at every moment to maintain tone generation, accordingly, enormous amount of memories must be incorporated in the event style expression.

SUMMARY OF THE INVENTION

The present invention has been made in consideration of the above situation and has a principal object to provide an automatic performance apparatus which previously stores performance data which realizes typical performance technique.

In order to achieve the object, an automatic performance apparatus according to the present invention, comprising, sequence data storing means for storing automatic performance data and performance technique data; performance data storing means for storing the performance data representing performance technique corresponding to the performance technique data; first reading means for reading out the automatic performance data from the sequence data storing means; second reading means for out reading performance data corresponding to the performance technique stored in the sequence data storing means from the sequence data memory; and tone generation means for generating musical tones based on the automatic performance data and the performance data.

In an automatic performance apparatus, according to the present invention, performance data storing means stores performance data which express plural kinds of performance techniques such as normal tone generation attack technique, normal release technique and special technique used during the performance. Performance technique designating data, which designates performance technique stored in the performance data storing means, are written into the sequence data memory means. At automatic performance, performance data, which corresponds to the performance technique designating data read out from the sequence data memory means, are read our from the performance data storing means and are sent to tone generators. The tone generators control musical tone generation based on the performance data. As a result, musical expression such as tonguing- or crescendo-technique can be realized simply by storing the performance technique designating data in the sequence data memory as a sequence data.

According to the automatic performance apparatus according to the present invention, owing to previously stored performance data to realize various performance techniques, various performance techniques can be applied to musical tones by storing one or more performance technique designating data with respect to each of the musical tones. As a result, performance representation of an automatic performance apparatus is extremely improved with minimization of necessary memory amount.

BRIEF DESCRIPTION ON THE DRAWINGS

FIG. 2 is a diagram showing a memory construction storing performance data for the automatic performance apparatus.

FIG. 3(A) through FIG. 6(D) are diagrams showing performance data necessary for various performance technique.

FIGS. 7(A) and 7(B) are diagrams showing sequence data of the automatic performance apparatus of the preferred embodiment of the present invention.

Figure 8:
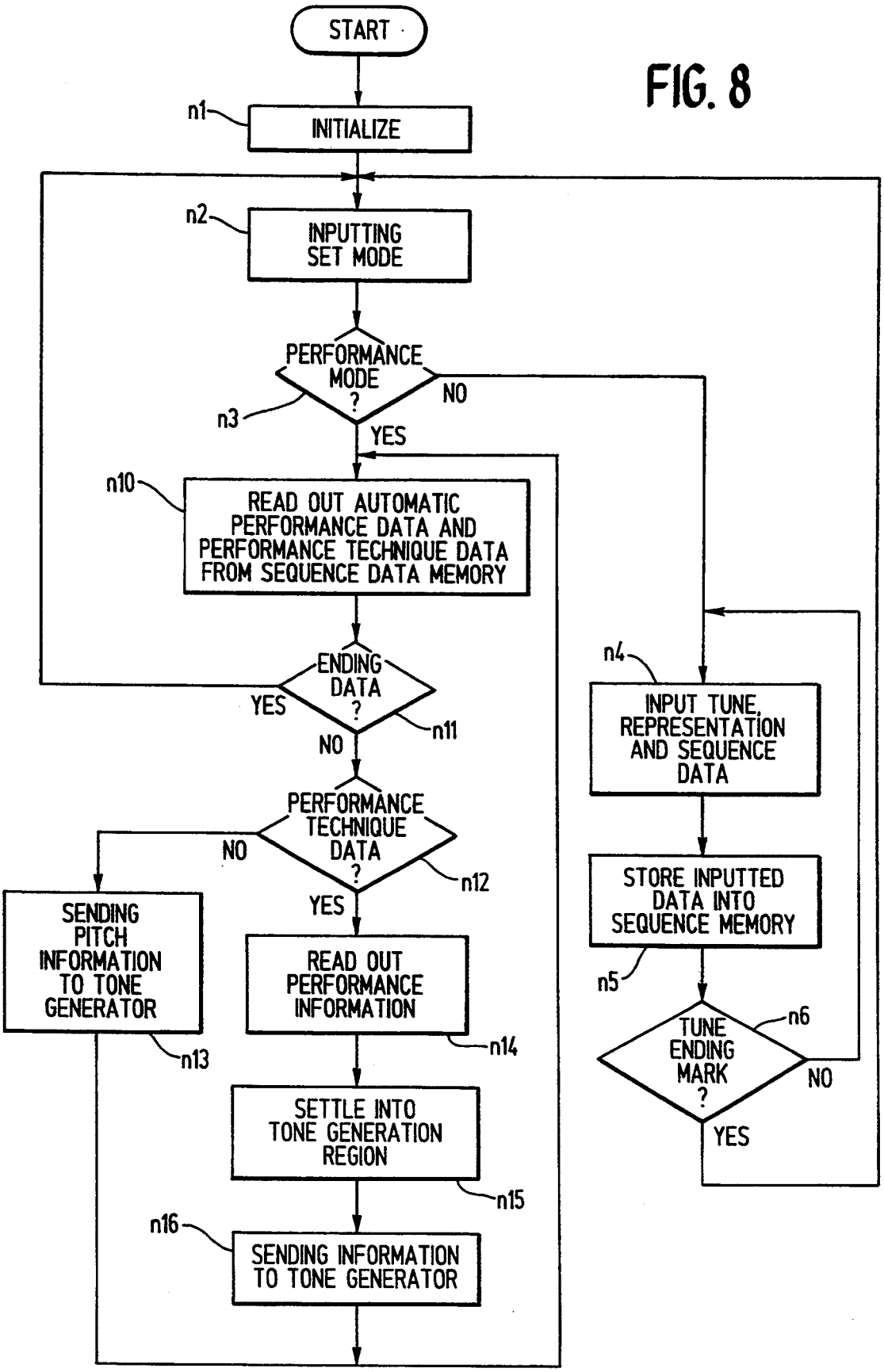

FIG. 8 is a flowchart showing a function of the automatic performance apparatus of the preferred embodiment of the present invention.

Figure 9:
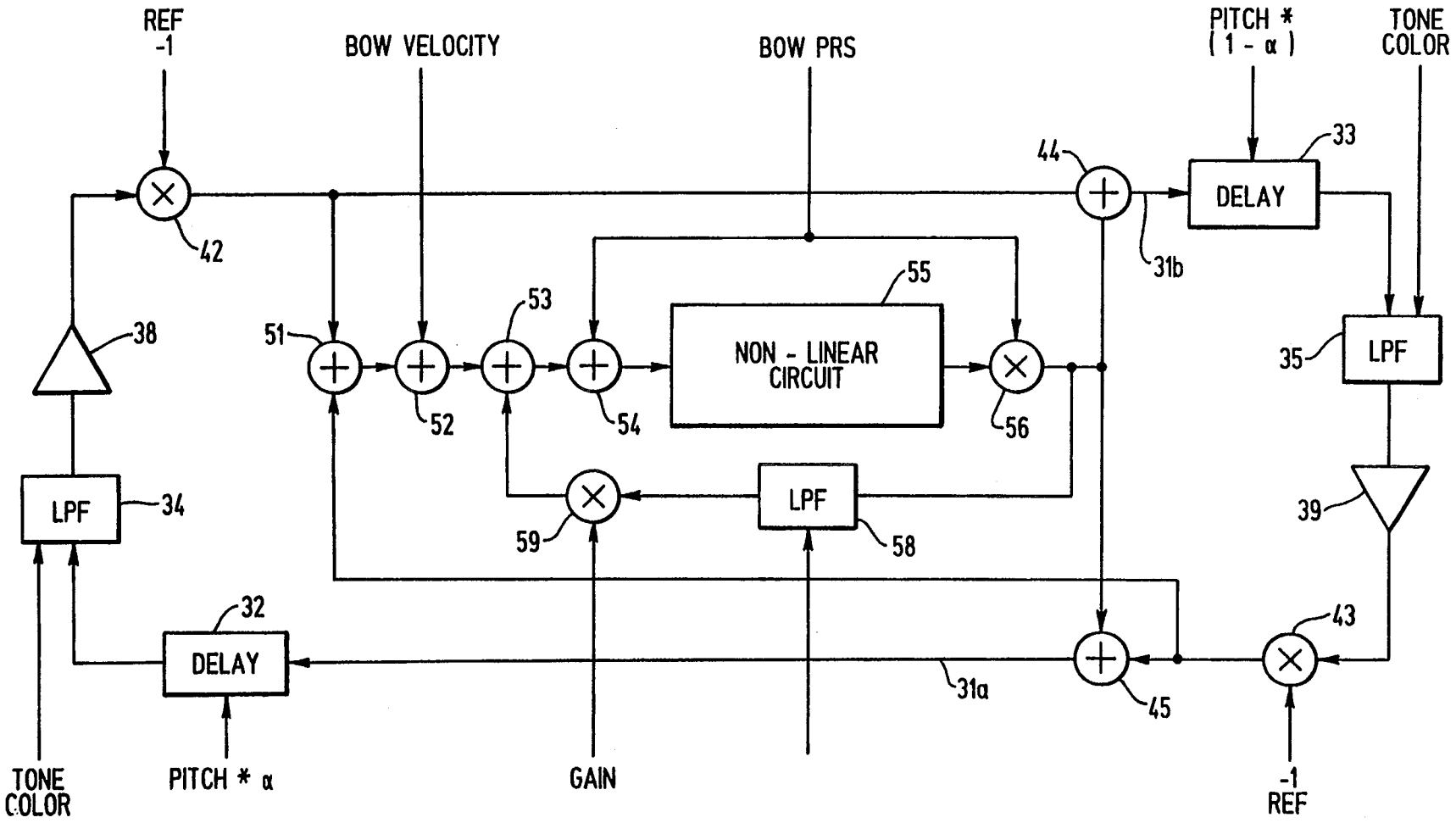

FIG.9 is a diagram showing an arrangement of a tone generator of the preferred embodiment of the present invention.

Figure 10:
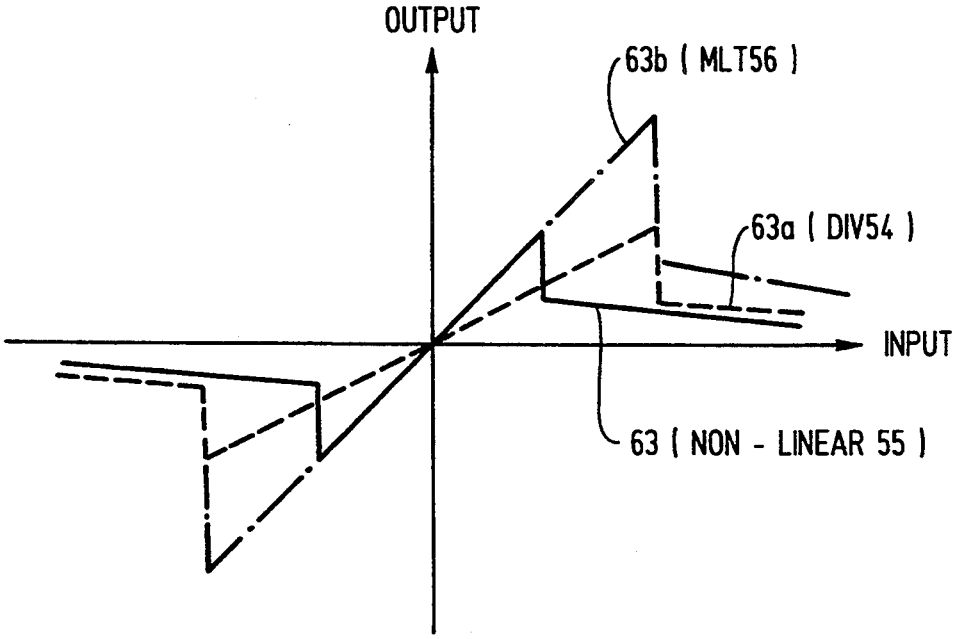

FIG. 10 is a diagram showing a non-linear characteristic stored in the nonlinear circuit of the tone generator of the preferred embodiment of the present invention.

DETAILED DESCRIPTION OF THE PREFERRED EMBODIMENT

An automatic performance apparatus according t a preferred embodiment of the present invention will be described by referring to accompanied drawings. The automatic performance apparatus serves as an electronic musical instrument also. To realize the musical performance, a keyboard 16 is incorporated into the automatic performance apparatus to enable performer to perform musical playing by his operation. To realize the automatic performance, a sequence data memory 15 is incorporated into the automatic performance apparatus to store and read out sequence data which includes automatic performance data. The automatic performance apparatus of the present invention incorporates a physical model tone generator. The physical model tone generator is defined as a tone generator which simulates tone generation mechanism of a natural musical instrument. In the physical model tone generator, waveshapes of musical tones, i.e. tone colors are controlled by data representing a real state of musical performance (performance data). An embouchure (bite pressure of a mouthpiece by a performer) or a breath pressure in a wind musical instrument, or a bow pressure or bow velocity in a string instrument, for example, are used as the performance data. Continuous memory of the performance data such as the embouchure or breath pressure enables precise reproduction of the musical tones. But an amount of data for a musical note enormously increases in this type of memory, accordingly, an amount of sequence memory also increases. Therefore, the complete performance data of typical performance techniques are separately stored in a performance data memory 14 from the sequence data. In the sequence data memory, the performance technique designating data are stored to specify one or more of the performance technique. For example, waveshapes representing the various attack or release portion of musical tone generation, crescendo technique, diminuendo technique, spiccato technique used in the string instrument, or tremolo technique used in the string instrument are stored in the performance memory 14.

Figure 1:
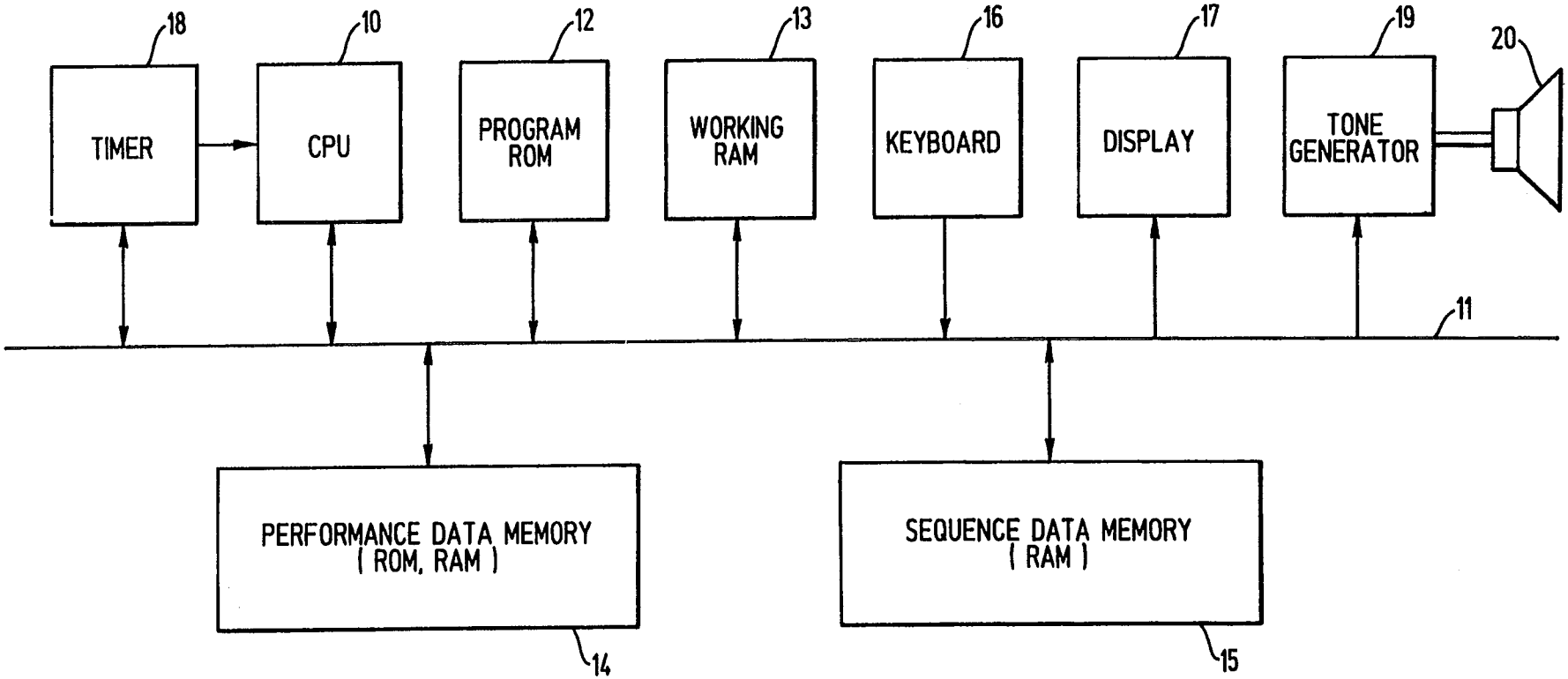
FIG. 1 is a explaining arrangement of an automatic performance apparatus of the preferred embodiment of the present invention.
Figure 3A:
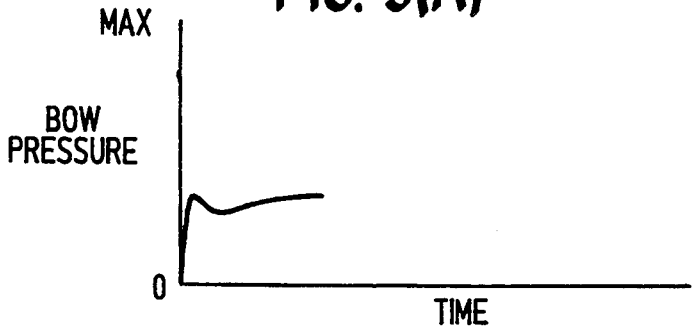
Figure 3B:
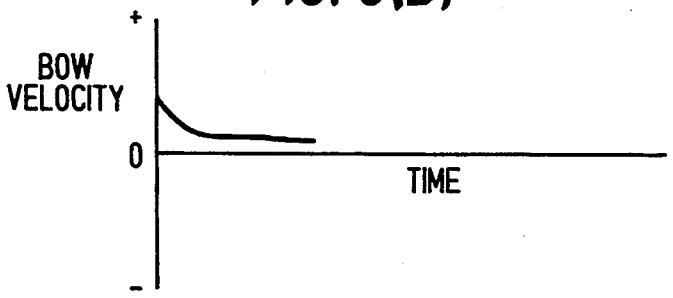
Figure 3C:
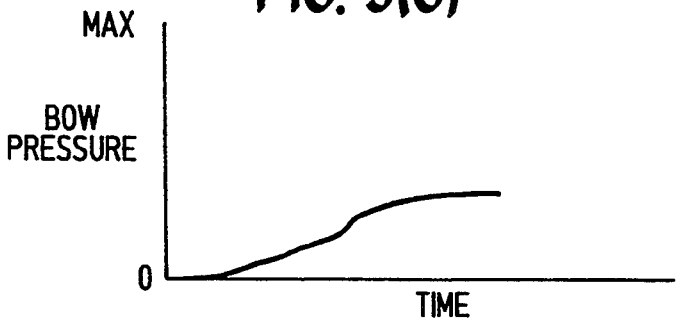
Figure 3D:
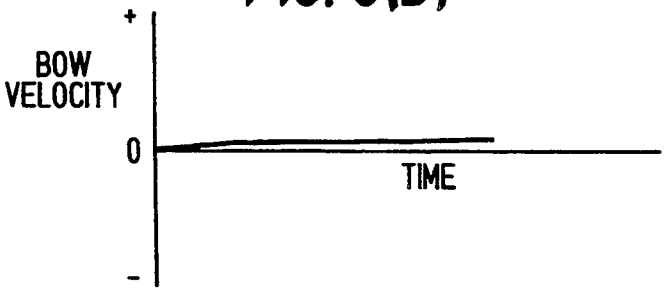
Figure 4A:
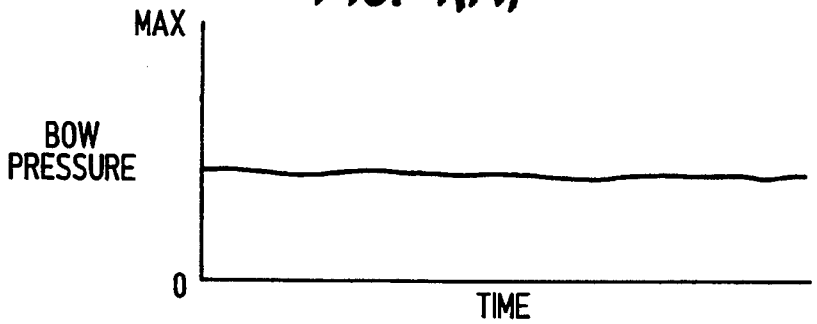
Figure 4B:
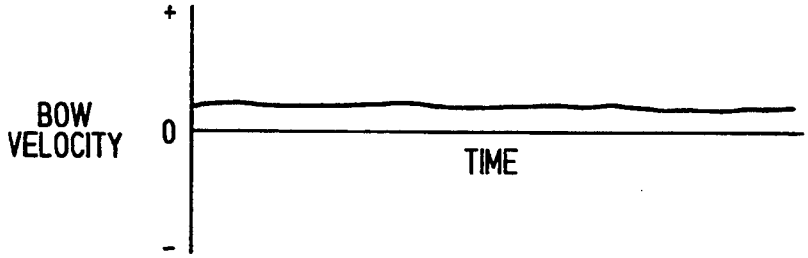
Figure 4C:
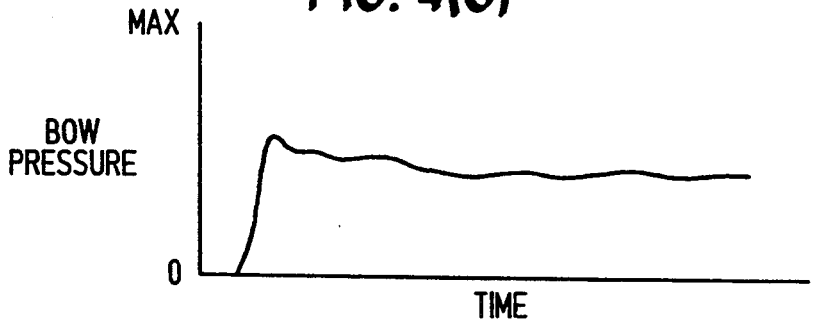
Figure 4D:
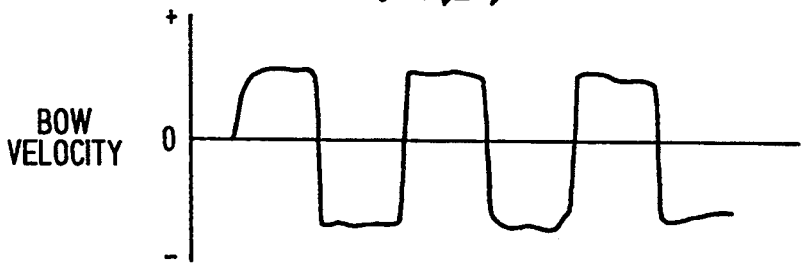
Figure 5A:
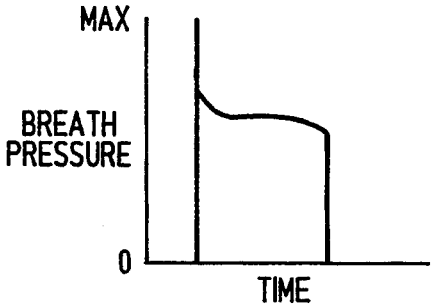
Figure 5C:
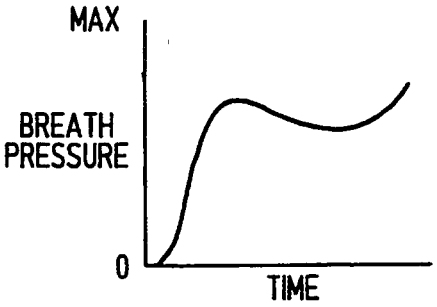
Figure 5B:
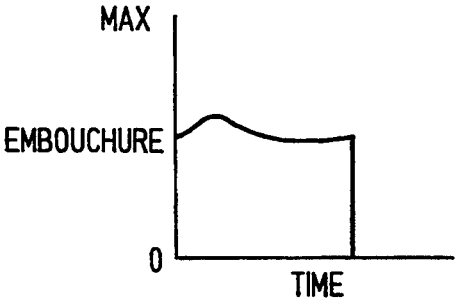
Figure 5D:
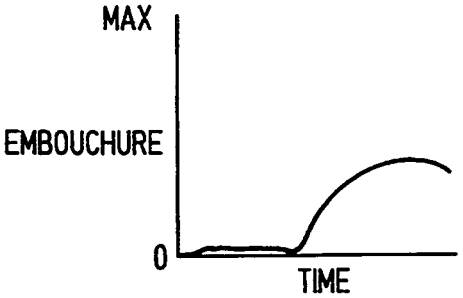
Figure 5E:
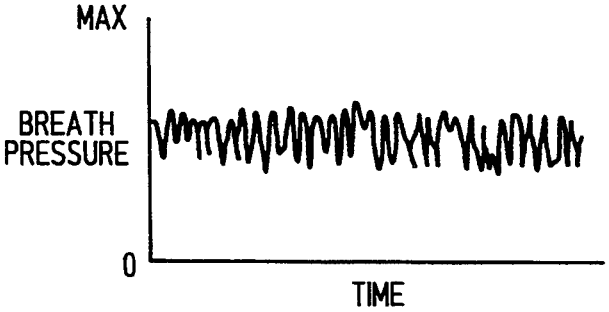
Figure 5F:
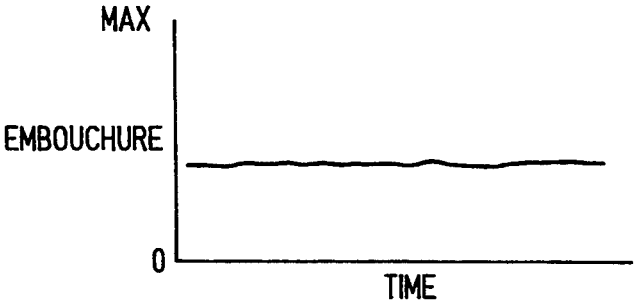
Figure 6A:
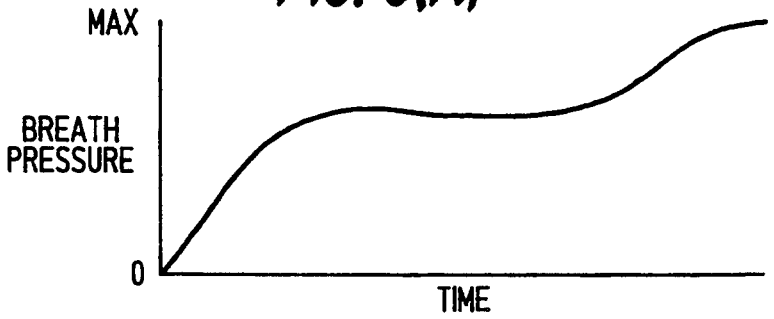
Figure 6B:
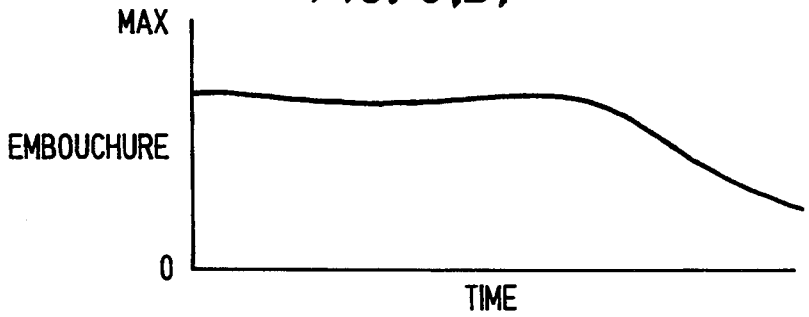
Figure 6C:
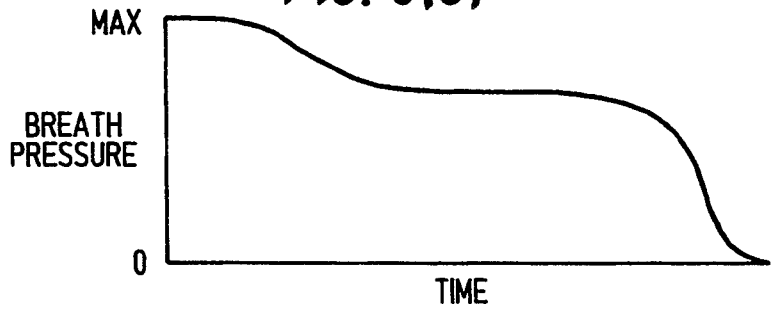
Figure 6D:
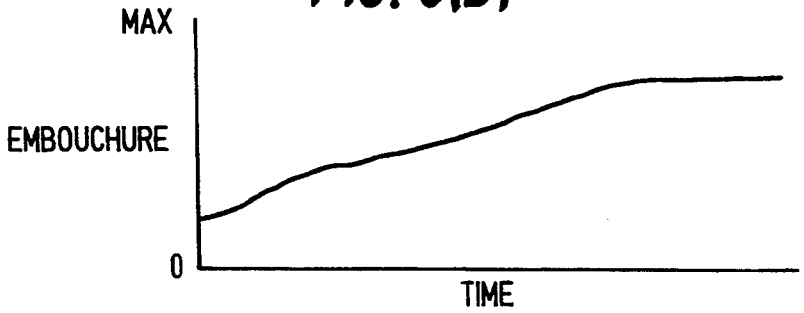

A block diagram of the automatic performance apparatus of the present invention is shown in FIG. 1. A CPU 10 controls the function of the automatic performance apparatus. The CPU 10 is connected through a bus 11 to a program ROM 12, a working RAM 13, a performance data memory 14, a sequence data memory 15, a keyboard 16, a display 17, a timer 18 and a tone generator 19. The program ROM 12 stores a program which is described hereinafter as a flowchart. The working RAM 13 has temporary registers which store various kinds of data generated during performance by the keyboard 16 or the automatic performance. The performance data memory 14 stores performance data representing various performance techniques of which state alter in a lapse of time as shown in FIG. 2 through FIG. 6(B). The sequence data memory 15 stores sequence data for the automatic performance as shown in FIG. 7. The keyboard 16 has keys which have about 5 octaves range. A manipulator for inputting various parameters, for example bow velocity or bow pressure applied to strings on the string instrument, for the above-mentioned physical model tone generator is incorporated into the keyboard 16. The display 17 displays inputted automatic performance data. The timer 18 is a electronic circuit which interrupts during the automatic performance the CPU 10 at a predetermined interval. The tone generator 19 includes the above-mentioned physical model tone generator which simulates of tone generation mechanism of various natural musical instrument such as the string instrument (for example, violin, viola, cello, etc.) or wind instrument (flute, oboe, trumpet, saxophone, etc.) in a electronic circuit approach. The wind instrument type physical model tone generator is disclosed in, for example, in the U.S. patent application Ser. No. 07/520,231 filed on May 8th, 1990 which is assigned to the same assignee of the present application. The tone generator 19 generates musical tone waveshape signal based on the performance data sent by the CPU 10. A sound system 20 is connected to the tone generator 19.

A memory construction of the performance memory 14 is shown in FIG. 2. A waveshape representing various musical performance technique, shown in FIG. 3(A) through FIG. 6(B), is stored in the performance data memory as performance data with respect each physical model which corresponds to a tone color. For a string instrument type physical model tone generator, a combination of bow pressure waveshape and bow velocity waveshape is stored in the performance memory 14 as a performance data. In addition, waveshape data of the musical performance technique such as fast attack portion shown in FIG. 3(A) and (B), slow attack portion shown in FIG. 3(C) and (D), detache, fast release, slow release, sustain portion in p (piano), sustain portion in f (forte) shown in FIG. 4(A) and (B), crescendo, diminuendo, spiccato, tremolo which a bow is operated in alternate directions shown in FIG. 4(C) and (D), etc. are also stored as the performance data. The detache means a musical performance technique which is realized by strongly rubbing on a string to apply high bow pressure on the string at tone generation timing and by simultaneously moving bow with high bow velocity. For a wind instrument type physical model tone generator, a combination of the embouchure waveshape and breath pressure waveshape is stored in the performance memory 14 as a performance data. In addition, waveshape data of the musical performance technique such as fast and slow attack portion, tongued attack portion shown in FIG. 5(A) and (B), fast release, slow release, tongued release, sustain portion in p (piano), sustain portion in f (forte) shown in FIG. 4(A), fast crescendo, slow crescendo shown in FIG. 6(A) and (B), diminuendo shown in FIG. 6(C) and (D), sobbing tone technique shown in FIG. 5(C) and (D), dirty tone technique shown in FIG. 5(E) and (F), subtone technique, etc. are also stored as the performance data. The sobbing tone technique is performance technique defined as generating tones by raising breath pressure or embouchure to thereby shifting pitches of the tones. The dirty tone technique is defined as generating tones by altering or vibrating the breath pressure by a performer. The physical model tone generator generates musical tone signals based on the above-mentioned performance data.

Sequence data which is used in the present invention are shown in FIG. 7(A) and (B). Sequence data for saxophone is shown in FIG. 7(A) and sequence data for violin is shown in FIG. 7(B). A section divided by a horizontal line corresponds to performance data for a note. Tone generation timing, pitch, note length, alteration of tone volume and tone color during note generation start through note release are sequentially stored as data representing performance technique in the sequence data memory 15. For example, the first saxophone tone constituted of a combination of tongued attack portion, fast diminuendo portion, mp (mezzo piano) sustain portion, slow crescendo portion, f (forte) sustain portion and tongued release. Stored period of respective performance data stored in performance data memory 14 is different among the performance technique. For example, attack data has short period, data of sustain portion has short period. When performance data having long period is designated, total period of designated performance for a note exceeds designated note length. In this case, to adjust period for one note to the designated note length, period of the sustain portion is controlled. When an excess amount of total period is beyond the above control range, the period is adjusted to the designated note length by reading in a skipping manner or repeatedly reading out in the sustain portion, as the case may be. The skipped reading or repeated reading in the sustain portion does not affect pitches of musical tones to be generated because the performance data simply represents movement of performance.

Flowchart according the preferred embodiment of the present invention is shown in FIG. 8. Initializing function, such as setting tone color parameters as previously set parameters, is executed in step n1. In step n2, mode setting input data is received. If the input data is an input mode in which automatic performance data are inputted, the flowchart proceeds to step n4. In step n4, sequence data such as timing data, pitch data, note length data which are designated by keys in the keyboard 16, or performance technique data are received. The received data are sequentially stored in the sequence data memory 15 in step n5. The step n4 and n5 are repeatedly executed until ending data representing end of the tune. Step n11 judges whether or not the read out data is an ending data representing the end of tune. If the read out data is the ending data, the flowchart is returned to the step n2. In step n3, if the input data is a performance mode, automatic performance data such as timing data, pitch data and note length data stored in the sequence data memory 15 are read out at a timing corresponding to the timing data stored in the sequence data memory 15 in accordance with interrupt tempo of the timer 18. In step n12, content of the read out data is judged. When the read out data are pitch data, i.e. the automatic performance data, the step proceeds to step n13 to sent the read out automatic performance data to the tone generator 19. When the read out data are performance technique designating data, the step proceeds to step n14. In the step n14, performance data, which simulates performance technique corresponding to the designated performance technique, are read out from the performance data memory 14. In the step n14, a length of performance technique data is adjusted in accordance with designated note length when the performance data are read out, as described previously. Next in step n15, the read out data is modified to a range in which a tone generator can generate tones based on the modified data without fail. This is because the physical model tone generator incorporated in the present invention only generates tones when a relation among plural performance parameters are in a predetermined condition. Next, in step n16, the modified data are sent to the tone generator 19. The tone generator 19 forms musical tone signals which simulate various performance techniques based on the pitch data and the performance data. Accordingly, the automatic performance is realized. Until the ending data is read out, the read out sequence is repeatedly performed.

An example of a string type, specifically, rubbed string type physical model tone generator for generating a musical tone signal based on bow velocity information, bow pressure information, tone pitch information, etc. is shown in FIG. 9. According to the performance data of a designated performance technique stored in the performance data memory 14, a bow velocity signal is generated and fed into an adder 52. The bow velocity signal is read out from the performance memory 14 and supplied to a non-linear circuit 55 through an adder 53 and a division circuit 54.

The non-linear circuit 55 is a circuit for representing the non-linear characteristic of a string of string instrument, for example, violin, viola, cello, etc. The non-linear characteristics of the non-linear circuit 55 includes, as is represented by the reference numeral 63 in FIG. 10, a substantially linear region from the origin to certain points, and outer regions of changed characteristic. When the string of a rubbed string instrument such as a violin is rubbed by the bow, as long as the bow velocity is slow, the displacement of the bow so that the movement of the string can be represented by the term of the static friction coefficient. This phenomenon can be represented by the substantially linear characteristic region containing the origin as its center. When the relative bow velocity to the string exceeds a certain value, the bow velocity and the string speed caused by its displacement are no longer the same. Namely, dynamic friction coefficient replacing with the static friction coefficient determines the movement of the string. This changeover from the static friction coefficient to the dynamic friction coefficient is represented by the step portion in FIG. 10.

In FIG. 9, the output of the non-linear circuit 55 is supplied to two adders 44 and 45 through a multiplication circuit 56.

The division circuit 54 on the input side and the multiplication circuit 56 on the output side of the non-linear circuit 55 receive the bow pressure signal and alter the characteristic of the non-linear circuit 55. The division circuit 54 on the input side changes the input signal to a smaller value by dividing it. Namely, as shown by the broken line **63*a* of FIG. 10, when the division circuit 54 is connected, even when a large input is applied, an output as if the input was small is generated. The multiplication circuit 56 on the output side plays the role of increasing the output of the non-linear circuit 55. Namely, the multiplication circuit 56 raises values according to the characteristic 63*a* produced by the division circuit 54 and the non-linear circuit 55 to a larger value of the output to produce a new characteristic as shown by the dot-and-dash line 63*b* of FIG. 10. Here, upon the same bow pressure signal, first dividing the input and finally multiplying the output represents dividing a characteristic by a coefficient C0 in the division circuit 54 and multiplying the result by the same coefficient C0 in the multiplication circuit 56. In this case, the total characteristic 63*b* of the dot-and-dash line lies on the extension of the characteristic 63 produced solely by the non-linear circuit 55**, and has a shape which is multiplied by C0 both in the abscissa and in the ordinate. It is also possible to differentiate the coefficient of the multiplication circuit from the coefficient of the division circuit, to generate a different shape.

The adders 44 and 45 are provided in half-circulating signal paths **31*a* and 31*b*. A circulating signal path constituted by the half-circulating signal paths 31*a* and 31*b* forms a closed loop for circulating the tone signal corresponding to the string of the rubbed string instrument. Namely, in the case of a string, the vibration is reflected at the opposite ends of the string and moves back and forth. In the case of a wind instrument, the vibration moves back and forth in its resonance body. This behavior is approximated by the closed loop in which a signal circulates. The circulating signal path includes two delay circuits 32 and 33, two low-pass filters (LPF) 24 and 25, two decay circuits 38 and 39, and two multiplication circuits 42 and 43. The delay circuits 32 and 33** are supplied with the products of the pitch signal representing the pitch and the coefficients a and (1-a) respectively so as to provide a predetermined delay time.

The total delay length required for circulating in the circulating signal paths **31*a* and 31*b* determines the fundamental pitch of a musical tone to be generated. Namely, the sum of the delay length of the two delay circuits 32 and 33** determines the fundamental pitch. One delay circuit corresponds to the distance from the position where the bow touches the string to the bridge, and the other delay circuit corresponds to the distance from the position where the bow touches the string to the depressed finger position.

Although the pitch is mainly determined by the delay circuits 32 and 33, other factors included in the circulating signal path such as LPFs 34 and 35, the decay controls 38 and 39, etc. also incorporate delay elements therein. Therefore, strictly, the pitch of the musical tone to be generated is determined by the sum of all delay length included in the loop.

The LPF 34 and 35 simulate the vibration characteristics of various strings by altering the transmission characteristics of the circulating waveform signal.

While the vibration propagates on the string, the vibration decays gradually. The decay controls 38 and 39 simulate the quantity of the decay of the vibration propagating on the string.

The multiplication circuits 42 and 43 multiply the input signal by the reflection coefficient −1 correspondingly to the reflection of the vibration at fixed ends of the string. Namely, assuming the reflection at the fixed ends without decay, the amplitude of the string is changed to the opposite phase reflection. The coefficient −1 represents this opposite phase reflection. The decay of the amplitude caused by the reflection is incorporated in the quantity of decay in the decay controls 38 and 39.

In the above-mentioned physical model tone generator, the bow velocity data and bow pressure data are read out from the performance data memory 14 and supplied to the adder 52 or the division circuit 54 and multiplication circuit 56, while delay length corresponding to the designated pitch or other parameters are read out from the sequence data memory 15. In the event style data memory, pitch data or other parameters are stored at respective changes of the performance data even if the pitch data, etc. does not change.

According to the preferred embodiment of the present invention, the performance data is separately stored in the performance data memory from the sequence data. In the sequence data memory 15, the performance technique designating data is stored replacing with entire performance data corresponding performance technique. Therefore, the pitch data or other parameters which are irrelevant to the performance technique is not necessary to be stored in the sequence data memory 15 while the performance data changes. As a result, the amount of sequence data enormously decreases.

Rich representation of the performance techniques are performed with a small amount of sequence data.

Further, the tone generator 19 is not only limited to a physical model tone generator, but FM (frequency modulation) or PCM (pulse coded modulation) type tone generator can be used. In this case, plural kinds of tone generation data which realize alteration in tone volume or tone color by various performance technique are stored as envelopes of tone volume, tone pitch, filter coefficients. In automatic performance, the stored performance data are selectively read out.

Although description has been made on the embodiments of the present invention is not limited thereto. For example, it will be apparent for those skilled in the art that various changes, substitutions modifications, improvements and combinations thereof may be made.

What is claimed is:

1. An automatic performance apparatus comprising:

technique data memory means for storing technique data which represent performance techniques performance data memory means for storing a sequence of automatic performance data, said automatic performance data including note performance data which identifies a musical tone to be produced and technique designating data which designates a portion of said technique data;

first reading means for reading out the automatic performance data from the performance data memory means;

second reading means for reading out said technique data designated by said technique designating data sequentially with the reading out of the automatic performance data by the first ring means and wherein the performance techniques are stored in the technique data memory in a time-independent manner; and musical performing means for performing a musical tone according to the note performance data using at least one performance technique determined by said read out technique data.

2. An automatic performance apparatus according to claim 1 wherein said note performance data includes pitch data identifying a pitch of said musical tone.

3. An automatic performance apparatus according to claim 1 wherein said automatic performance data further includes note duration data which specifies a duration of said musical tone, and wherein said automatic performance apparatus further includes modifying means for modifying said technique data in accordance with the note duration data.

4. An automatic performance apparatus according to claim 1 wherein said technique data comprises a sequence of values representing temporal changes in said technique data.

5. An automatic performance apparatus according to claim 1 wherein said tone generating means simulates a tone generation mechanism of an acoustic stringed instrument, and said technique data represents a change in bow speed or bow pressure.

6. An automatic performance apparatus according to claim 1 wherein said tone generating means simulates a tone generation mechanism of an acoustic brass or wind instrument, and said technique data represents a change in breath pressure or embouchure.

7. An automatic apparatus according to claim 1 wherein the technique data memory means stores a plurality of technique data each of which represents a different performance technique, and each of said technique designating data designates one of said plurality of technique data.

* * * * *